United States Patent [19]

Smith

[11] Patent Number: 5,063,377

[45] Date of Patent: Nov. 5, 1991

[54] DISPLAY SYSTEM

[75] Inventor: Glenn W. Smith, Baton Rouge, La.

[73] Assignee: Robotic Displays Corporation, Baton Rouge, La.

[21] Appl. No.: 421,264

[22] Filed: Oct. 13, 1989

[51] Int. Cl.[5] ..... G09G 3/16

[52] U.S. Cl. ..... 340/764; 340/815.08; 40/473

[58] Field of Search ..... 340/783, 764, 815.01, 340/815.02, 815.08, 815.09, 815.21, 815.26; 40/473, 484, 493, 494, 503, 501, 509, 511; 273/153 S

[56] References Cited

U.S. PATENT DOCUMENTS

| | | | |
|---|---|---|---|
| 2,798,319 | 7/1957 | Roca . | |
| 2,929,330 | 3/1960 | Ray . | |
| 3,199,444 | 8/1965 | Schwartz | 340/764 |
| 3,263,920 | 8/1966 | Reed | 40/494 |
| 3,304,638 | 2/1967 | Grandell et al. . | |
| 3,340,633 | 12/1967 | Siberman | 40/473 |
| 3,471,148 | 10/1969 | Janiszewski et al. . | |
| 3,660,917 | 5/1972 | Bevan . | |
| 3,717,942 | 2/1973 | Presby | 40/503 |
| 3,798,808 | 3/1974 | VanWagenen et al. . | |
| 4,189,859 | 2/1980 | Ahlgren . | |
| 4,353,179 | 10/1982 | Jennings | 40/431 |
| 4,442,942 | 4/1984 | Cuminale et al. . | |

*Primary Examiner*—Alvin E. Oberley
*Assistant Examiner*—Xiao Wu
*Attorney, Agent, or Firm*—Robert C. Tucker; William David Kiesel

[57] ABSTRACT

Accordingly, a display system is provided whereby visual elements can be independently transported not only around but also parallel to the display axis. The display comprises a central shaft; carriages mounted along the length of this shaft; and visual elements borne by the carriages. Each carriage has a circumferential drive train which can propel it around the shaft, and an axial drive train engageable with a visual element such that the visual element can be passed generally parallel to the shaft from one carriage to an axially adjacent carriage. Ideally, the system is controlled by a computer system which may be programmed to move the carriages and visual elements in complex configurations.

20 Claims, 13 Drawing Sheets

DISPLAY SYSTEM

BACKGROUND OF THE INVENTION

1. Field of the Invention

This invention relates generally to automated visual display systems and, more particularly, to displays which rotate or move visual elements, such as advertising signs or kinetic sculptures.

2. Description of Prior Art

Typical moving displays, such as advertising signs, operate by rotating a visual element (such as sign) around a support, such as a pole, utilizing a motor to rotate the sign. U.S. Pat. Nos. 3,660,917 (Bevan) and 3,798,808 (Van Wagenen et al) are examples of such devices. The movement of visual elements in this manner is relatively uninteresting in an industry where eye-catching movement is desirable. Also, the classic rotating sign is limited in its ability to generate advertising revenue. Varying advertising needs demand a versatile moving sign structure which is eye-catching and easily adaptable to different situations.

SUMMARY OF THE INVENTION

Therefore, it is an object of this invention to provide a display system and method which allows a visual element to be moved in a desired pattern of movement, which is not necessarily the constant rotation of the visual element about a support.

It is another object of this invention to provide a display system and method which includes multiple visual elements with multiple faces, the visual elements being movable about a support in a desired pattern so as to expose the faces in different directions.

It is still another object of this invention to provide a display system and method which allows the display of independently movable visual elements on multiple levels of a support structure.

It is a further object of this invention to provide a display system and method which allows visual elements to be displayed on multiple levels of support structure and which allows a particular visual element to be transferred in position from one level to another.

It is still a further object of this invention to provide a display system and method which accomplishes all of the above objectives in varying combinations.

Accordingly, a display system is provided whereby visual elements can be independently transported not only around but also parallel to the display axis. The display system comprises a central shaft; carriage assemblies mounted along the length of the shaft; and visual element assemblies borne by the carriage assemblies. Each carriage assembly has a circumferential drive train which can propel it around the shaft, and an axial drive train engageable with a visual element such that the visual element can be passed generally parallel to the shaft from one carriage assembly to an axially adjacent carriage assembly. Ideally, the system is controlled by a computer system which may be programmed to move the carriage assemblies and visual elements in complex configurations.

The carriage assemblies act independently, each under its own motive power, to move visual elements circumferentially about the shaft. Axial movement of the visual elements occurs when one carriage is axially aligned adjacent to another and the visual element is passed from one carriage to another utilizing the axial drive trains. By increasing the number of carriages and axial carriage positions, extremely complex visual movement patterns are possible.

DETAILED DESCRIPTION OF PREFERRED EMBODIMENTS OF THE INVENTION

Figure 1:
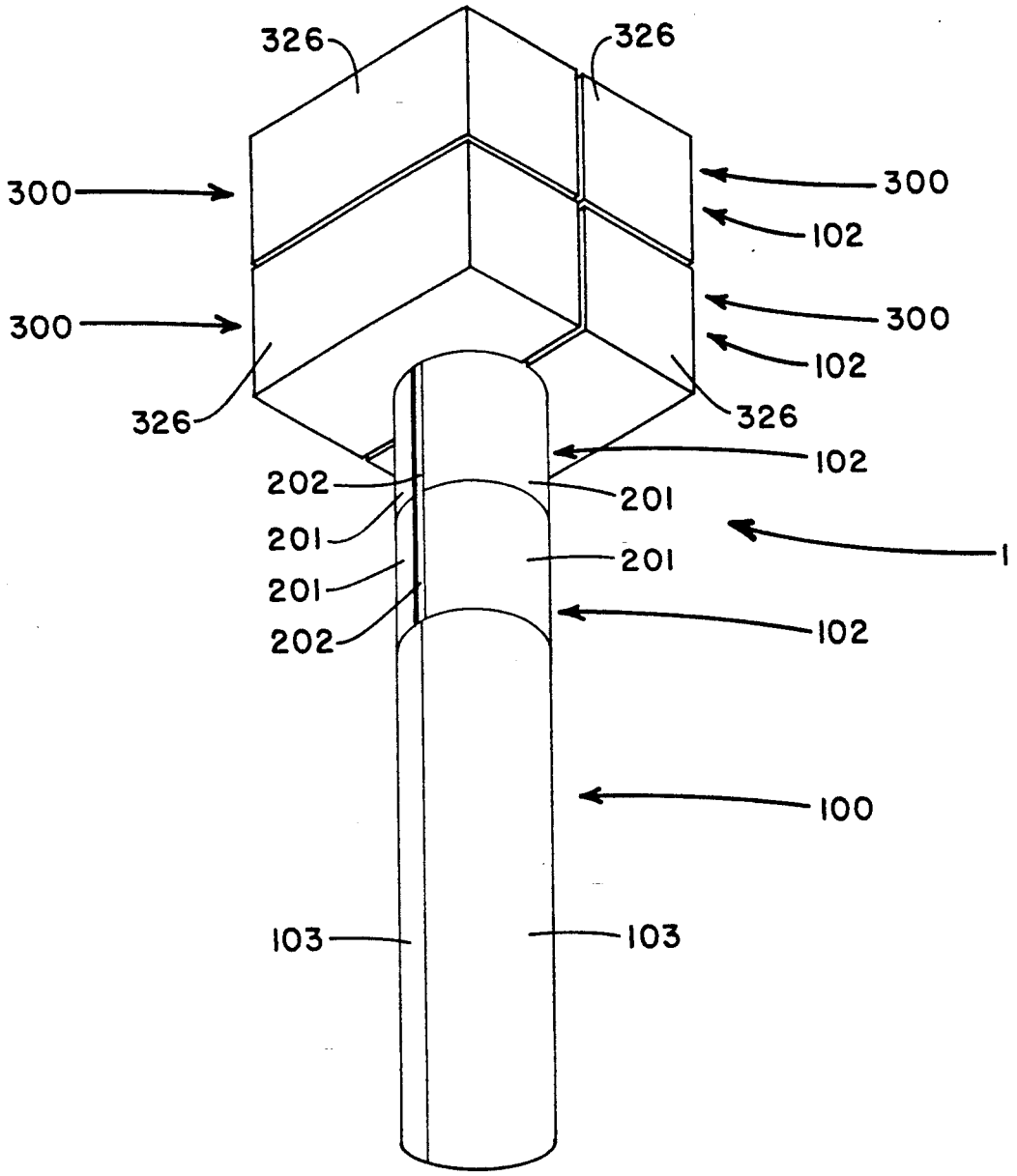
FIG. 1 is a perspective view of one embodiment of the invention.
Figure 7:
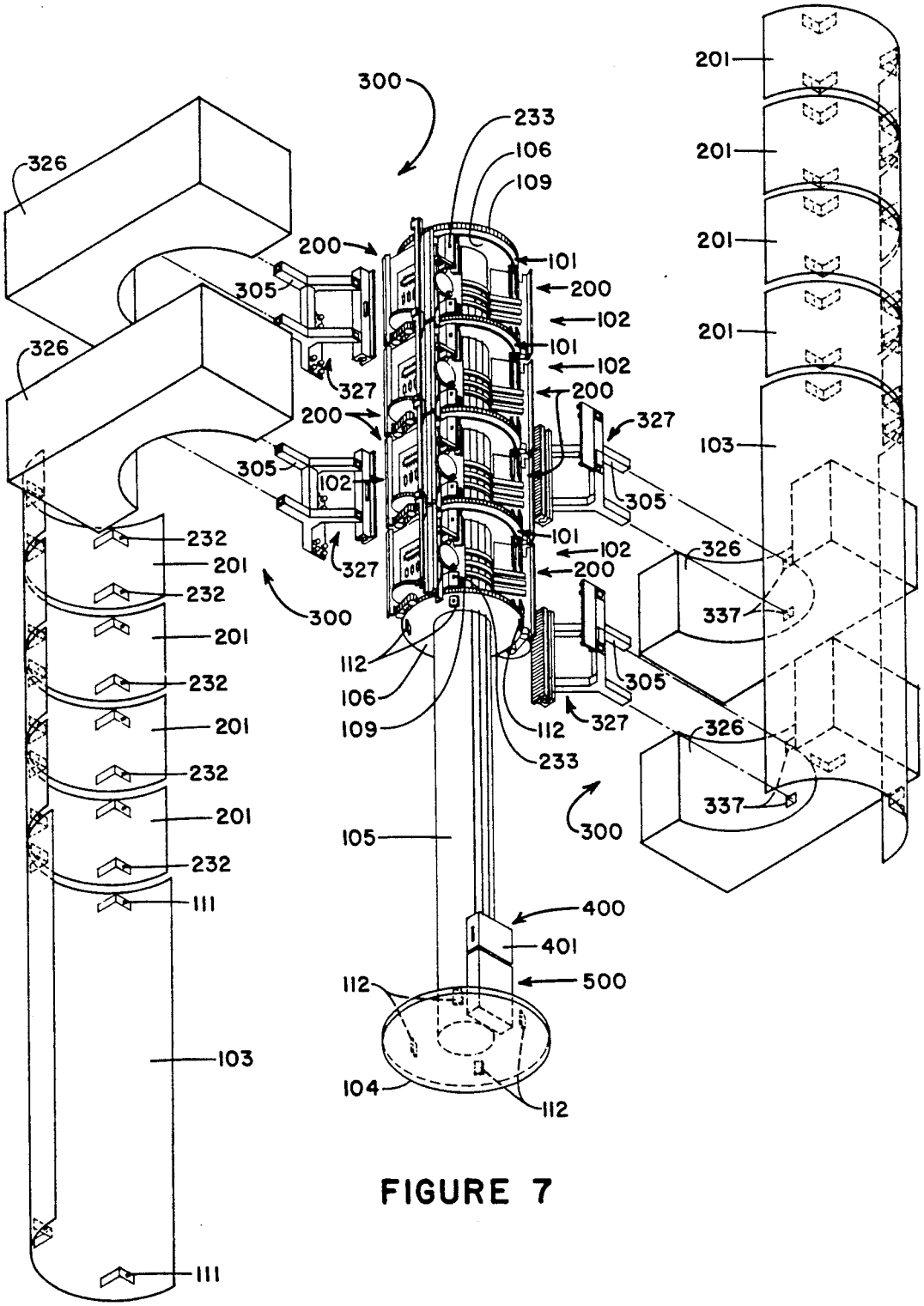
FIG. 7 is an exploded perspective view of an embodiment of the invention.

As shown generally in FIGS. 1 and 7, the display system 1 generally comprises a shaft means, or central shaft assembly, generally designated by the number 100; at least one carriage means (not visible in FIG. 1), or robotic carriage assembly, generally designated by the number 200; and at least one visual element, comprising a visual element assembly, generally designated by the number 300. The system 1 is preferably operated via a control means, or control system, generally designated by the number 400, including a master computer 401. Power is furnished by a power supply means 500.

Visual element assemblies 300 are movable circumferentially about shaft assembly 100 as well as axially along shaft assembly 100. Each visual element assembly 300 generally comprises a visual element body 326 and a visual element slide 327. The slide 327 connects the visual element body 326 at all times to a carriage assembly 200, from which the visual element assembly 300 projects radially outward, as shown. Carriage assemblies 200 are supported by and move circumferentially around shaft assembly 100 on track means 101. Track means 101 are arranged in levels 102, allowing carriage assemblies 200 to be disposed on each level 102. Axial movement of visual element assemblies 300 occurs when two or more carriage assemblies 200 on different levels 102 are axially aligned, and one carriage assembly 200 transfers a visual element assembly 300 to another carriage assembly 200 axially adjacent thereto. Although in the embodiments shown the shaft assembly 100 is vertically oriented, there is no requirement for such orientation. For example, shaft assembly 100 could be diagonally inclined or horizontally oriented. Track means 101 serve to retain carriage assemblies 200 on the shaft assembly 100 regardless of the orientation of shaft assembly 200. For the purposes of this invention, the term "circumferential" is used to describe any movement of carriage assemblies 200 and/or visual element assemblies 300 generally around shaft assembly 100. The term "axial" is used to describe any movement of visual element assemblies 300 generally parallel to shaft assembly 100 between aligned carriage assemblies 200 on different adjacent levels 102.

The movement and display combinations possible with the system 1 are virtually limitless. FIGS. 2–6, all showing the system 1 from the same angle, illustrate typical movement of four visual element assemblies 301, 302, 303 and 304 circumferentially around and axially along shaft assembly 100. Shaft assembly 100 is preferably provided with cosmetic cowling 103 which covers parts (wiring, structural elements, etc.) which may be undesirable for the public to view. Cowling 103 ma actually form a part of the visual presentation of the display systems 1. Similarly, carriage cowlings 201 cover the internal workings of carriage assemblies 200 and may also form part of the visual presentation of the display system 1. Thus, all externally visible parts of the system 1 may form part of the presentation. Carriage cowlings 201 are arranged so as to provide slots 202 through which the bodies 326 of visual element assemblies 301-304 are connected to carriage assemblies 200 by extension arms 305 (see FIG. 7). The extension arms 305 are part of the visual element slide 327. In the embodiment shown in FIGS. 2–6 visual element 301 has face sections 306–308. Visual element 302 has face sections 309–311. Visual element 303 has face sections 312–314. Visual element 304 has face sections 315–317. Of course, all face sections are not visible in each Figure.

Figure 2:
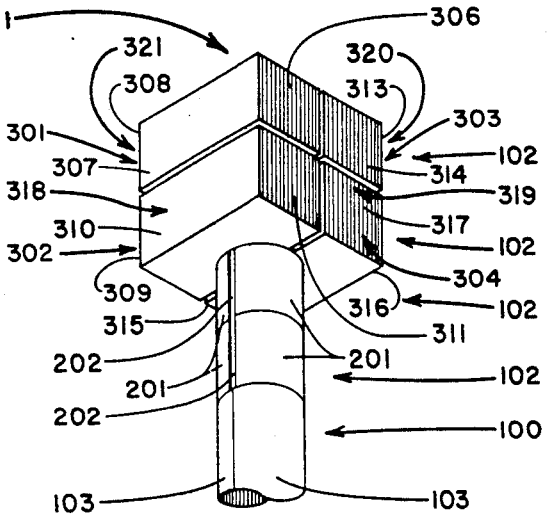
FIG. 2 is a perspective view of an embodiment of the invention illustrating the positioning and movement of visual element assemblies.

In FIG. 2, the system 1 is shown in a typical static viewing configuration, with the individual face sections 306–317 forming four complete display faces 318–321, of which only 318 and 319 are visible. Display face 318 comprises face sections 307 and 310. Display face 319 comprises face sections 306, 314, 317 and 311. Likewise, display face 320 (not visible in FIG. 2) comprises face sections 313 and 316, and display face 321 (not visible in FIG. 2) comprises face sections 308, 312, 315 and 309.

Figure 3:
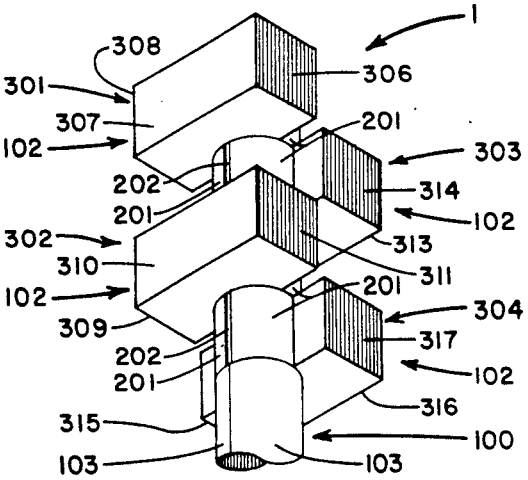
FIG. 3 is a perspective view of an embodiment of the invention illustrating the positioning and movement of visual elements.

In FIG. 3, visual element assembly 302 has moved axially downward one level 102, visual element assembly 303 has moved axially downward one level 102, visual element assembly 304 has moved axially downward two levels 102 and visual element assembly 301 has not moved. All of the axial movement is accomplished when axially aligned carriage assemblies 200 (not shown due to cowlings 201) transfer visual element assemblies 302-304 to different levels 102.

Figure 4:
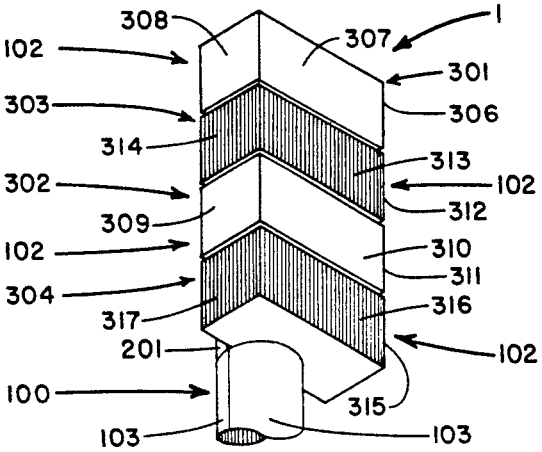
FIG. 4 is a perspective view of an embodiment of the invention illustrating the positioning and movement of visual elements.
Figure 5:
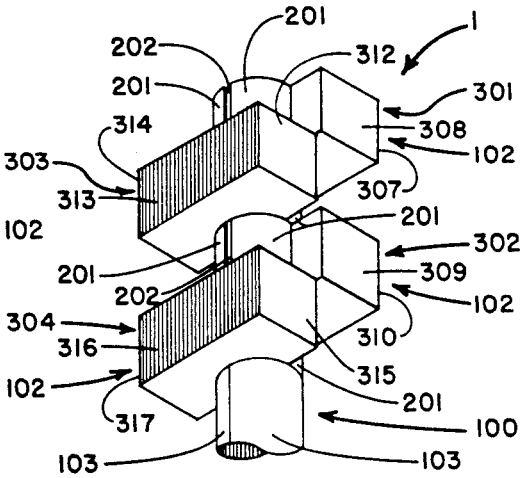
FIG. 5 is a perspective view of an embodiment of the invention illustrating the positioning and movement of visual elements.

In FIG. 4, visual element assemblies 301 and 302 have moved circumferentially one-quarter turn counterclockwise and visual element assemblies 303 and 304 have moved circumferentially one-quarter turn clockwise. All of the circumferential movement is accomplished when carriage assemblies 200 move around shaft assembly 100, carrying visual element assemblies 300 with them. In FIG. 5, the visual element assemblies 301-304 have continued to rotate an additional one-quarter turn in the same directions, again depending upon circumferential carriage assembly movement for the change in positions.

Figure 6:
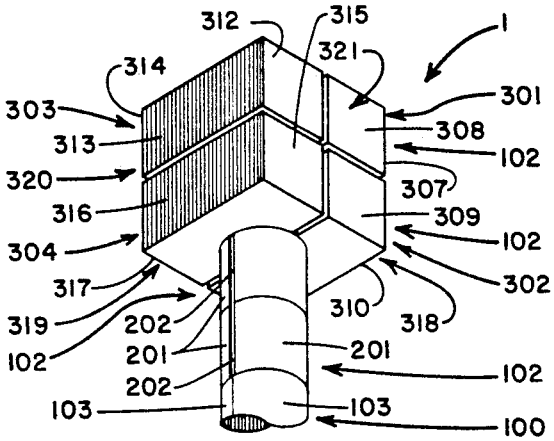
FIG. 6 is a perspective view of an embodiment of the invention illustrating the positioning and movement of visual elements.

In FIG. 6, visual element assembly 303 has moved axially upward one level 102, visual element assembly 304 has moved axially upward two levels 102, visual element assembly 302 has moved axially upward one level 102 and visual element assembly 301 remains at the same level 102 as it was in FIG. 5. Thus, the display is once again in a typical static viewing configuration, exposing the same four display faces 318-321, comprising the same face sections 306-317. However, display faces 320 and 321 are visible in FIG. 6, as opposed to display faces 318 and 319 being visible in FIG. 1. The position of the faces has been reversed in an eye-catching choreography.

The system 1 can therefore be utilized to rearrange a moving or static display in a variety of ways. While the circumferential movement shown in the Figures is circular around shaft assembly 100, this is not necessary. Track means 101 may be skewed or otherwise designed to allow carriage assemblies 200 to track around shaft assembly 100 in various patterns. Similarly, axial movement of visual element assemblies 300 is only limited by the orientation and alignment of axially adjacent carriage assemblies 200. Also, since alignment of two axially adjacent carriage assemblies 200 is the only positioning requirement for axial movement, axial movement can take place between two or more axially adjacent carriage assemblies 200 while they are moving circumferentially in unison. Given the versatility of the system 1, movement of visual element assemblies 300 may be choreographed and coordinated utilizing master computer 401 in intricate fashion, moving visual element assemblies 300 over multiple levels 102. The following is more detailed discussion of the assemblies of the invention 1.

As shown in FIG. 7, shaft assembly 100 (shaft means), is the central support for the system 1. In the embodiments shown, shaft assembly 100 generally comprises a vertically oriented shaft 105 supported by a base 104. Cowling 103 covers electrical and communications lines which run along or inside of shaft 105. Details of the electrical and communications system will follow. If desirable, master computer 401 and power supply 500 may be housed in or on base 104.

Figure 8:
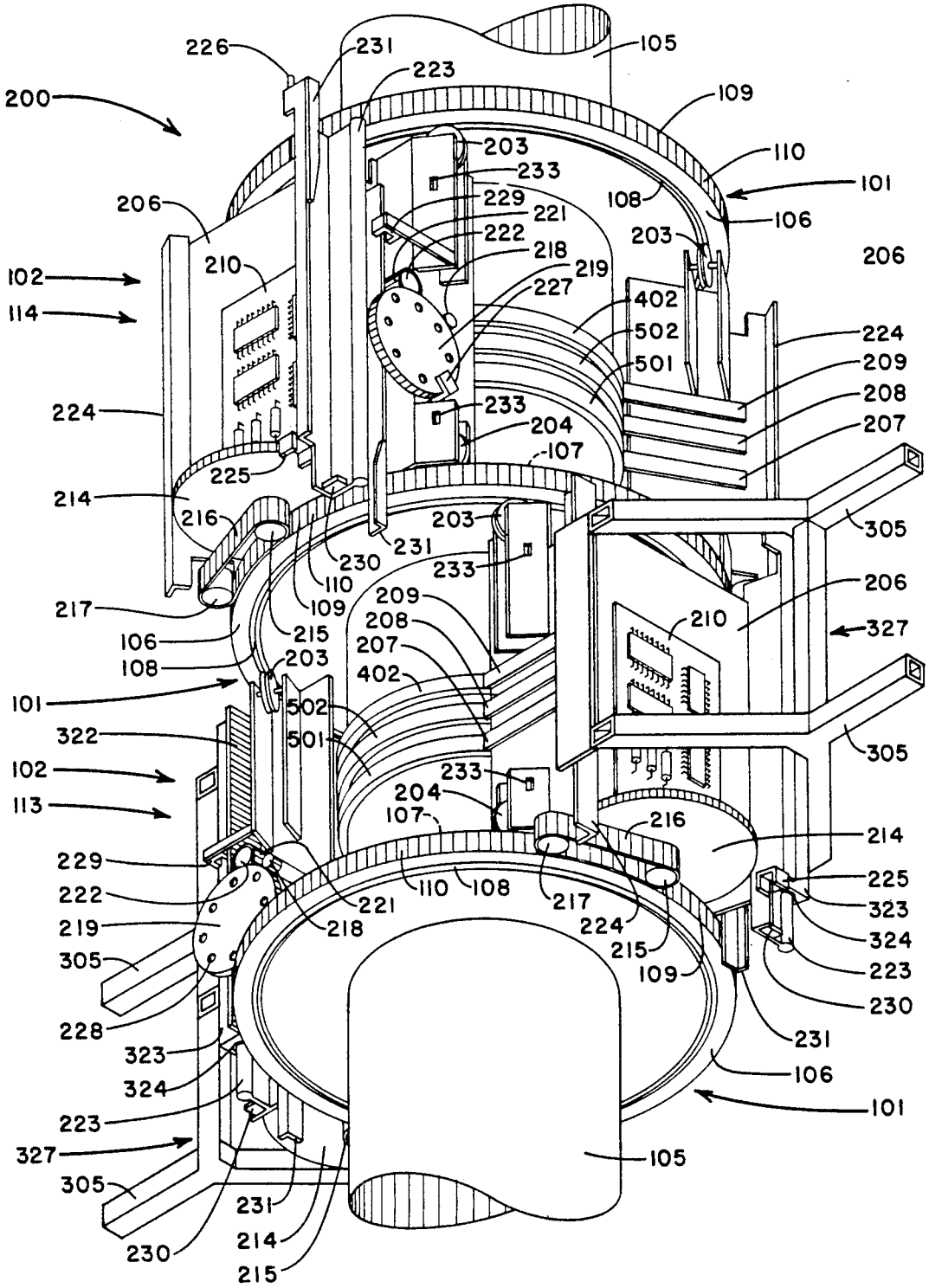
FIG. 8 is a perspective view of a preferred embodiment of the invention with selected parts removed for clarity.
Figure 9:
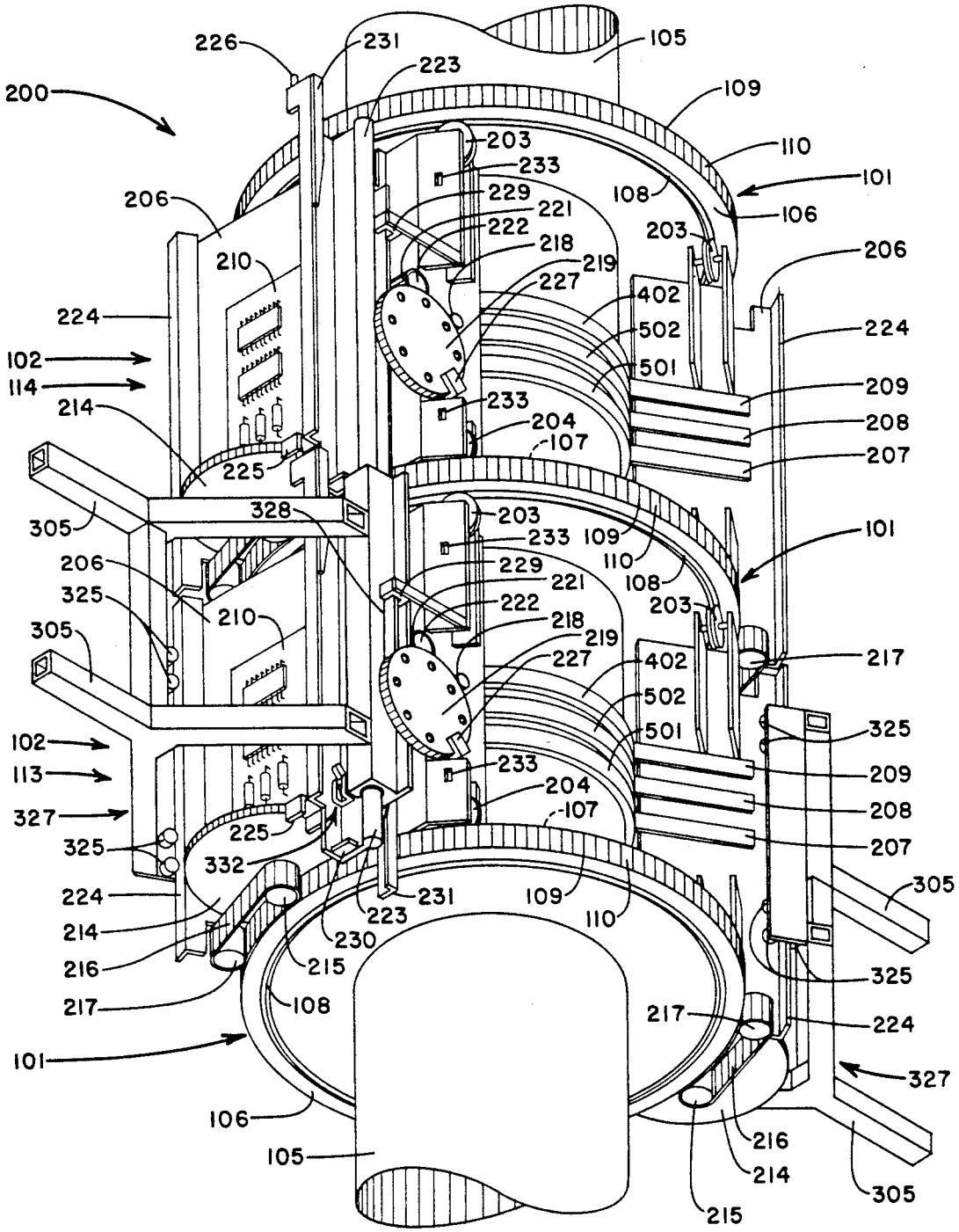
FIG. 9 is a perspective view of the embodiment of the invention shown in FIG. 8, illustrating different positioning of the carriage assemblies of the invention.
Figure 10:
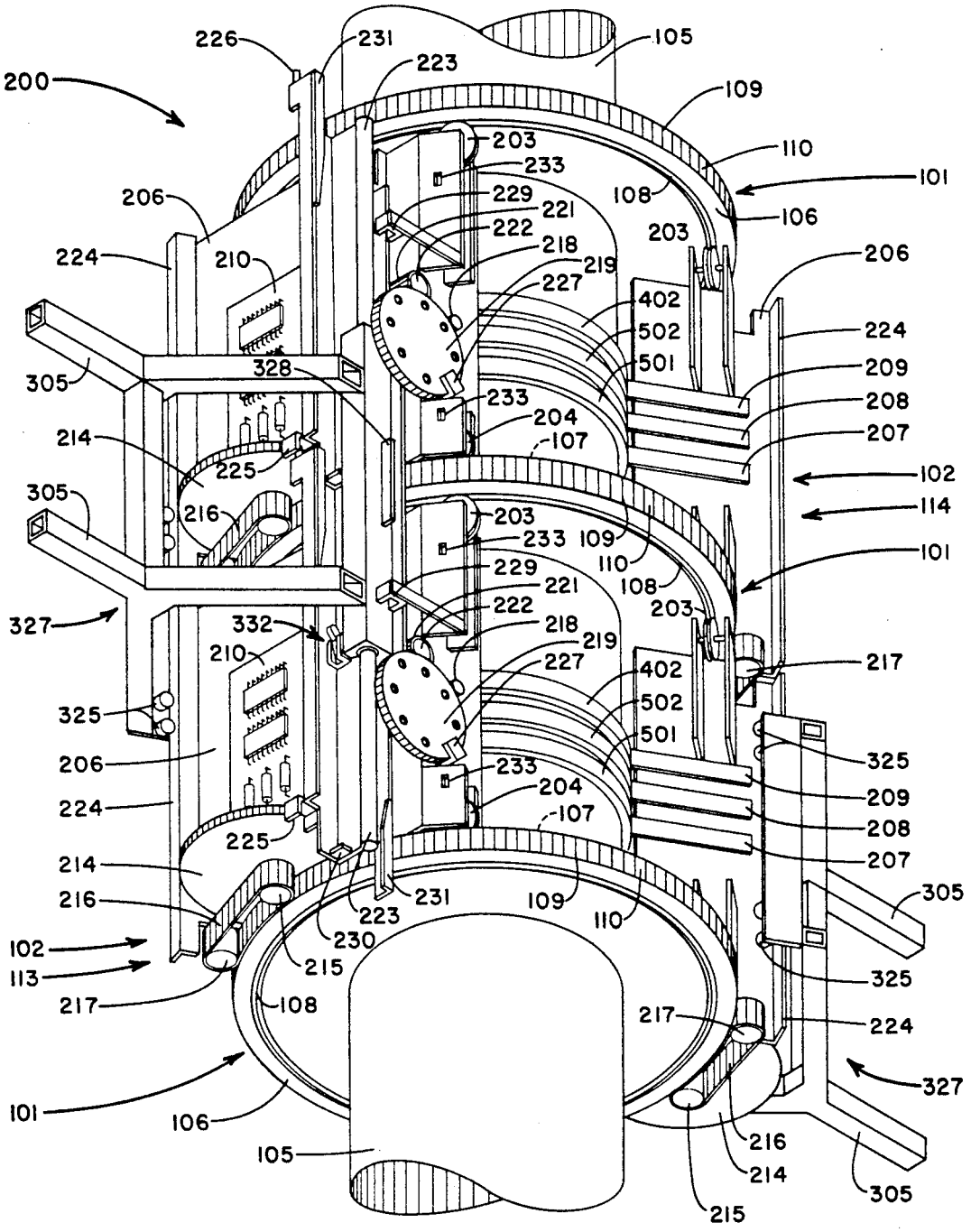
FIG. 10 is a perspective view of the embodiment of the invention shown in FIG. 9, illustrating movement of the visual elements of the invention.
Figure 11:
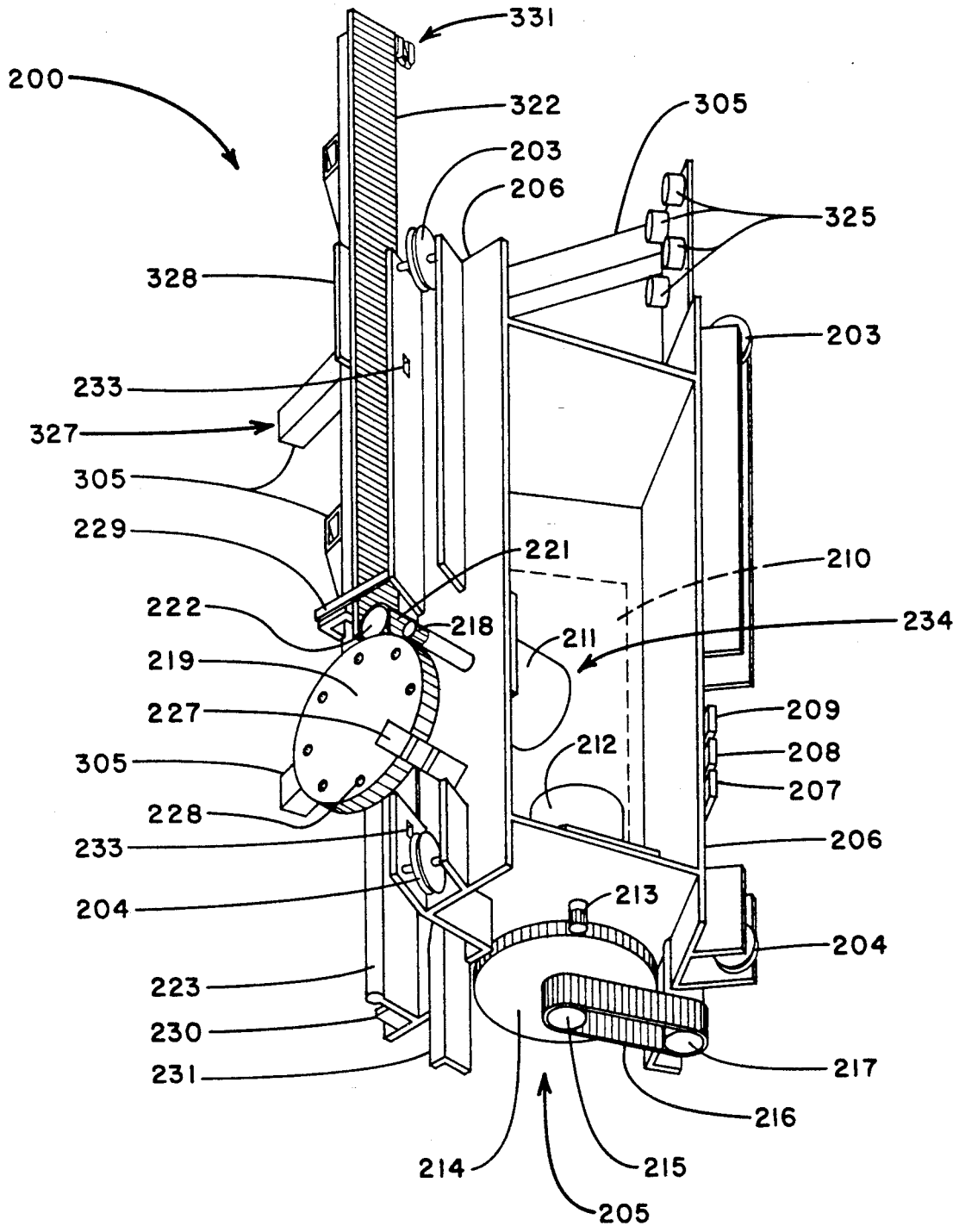
FIG. 11 is a perspective view of the rear of a carriage assembly of a prepared embodiment of the invention.

FIGS. 8 through 10 show in greater detail two levels 102, four carriage assemblies 200, and two visual element slides 327. The carriage cowlings 201 and visual element bodies 326 have been removed in these Figures to reveal mechanical details. FIG. 11 shows a carriage assembly 200 and an engaged visual element slide 327 from a rear perspective.

In the embodiment shown, track means 101 comprise a series of flanges 106, each having a top "V" boss 107 and a bottom "V" boss 108. For each level 102, top grooved carriage wheels 203 ride in the bottom "V" boss 108 of the flange 106 above a carriage assembly 200, and bottom grooved carriage wheels 204 ride in the top "V" boss 107 of the flange 106 below a carriage assembly 200. Thus, a pair of axially adjacent flanges 106 define a level 102. Flange gear teeth 109 are provided on the periphery of flanges 106 and are engageable with circumferential drive means 205 (shown in FIG. 11) of the carriage assemblies 200. In a preferred embodiment of the invention, flange gear teeth 109 are implemented as a toothed belt 110 fixedly attached to the periphery of flanges 106. Flanges 106 thus retain carriage assemblies 200 and guide them around shaft 105, regardless of the orientation of shaft 105. Multiple levels 102 are added simply by adding flanges 106.

Each carriage assembly 200 includes a chassis 206, on which the various parts of the carriage assembly 200 are mounted. Top carriage wheels 203 and bottom carriage wheels 204 are mounted on chassis 206 as shown. Power contact brush 207, ground contact brush 208 and communications contact brush 209 provide operative connections between the carriage assembly 200 and power slip ring 501, ground slip ring 502 and communications slip ring 402, respectively. Slip rings 50!, 502 and 402 are provided at each level 102. A circuit board 210 provides the necessary electrical and communication component links from the power supply 500 and master computer 401 to an axial drive step motor 211 and a circumferential drive motor 212 (shown in FIG. 11).

Circumferential drive step motor 212 drives a circumferential drive pinion 213, which drives a circumferential drive gear 214, to which is connected a circumferential drive pulley 215. A circumferential drive tractor belt 216 is attached around drive pulley 215 and a circumferential idler pulley 217. Teeth on drive belt 216 mesh with toothed belt 110 on flange 106. Thus, circumferential carriage assembly 200 will engage the outer periphery of flange 106 and travel around shaft 105 according to the operation of circumferential drive step motor 212.

Axial drive means 234, utilizing axial drive step motor 211 provides force to transfer a visual element assembly 300 axially from one carriage assembly 200 to another. Axial drive step motor 211 drives axial drive pinion 218, which in turn drives axial drive gear 219, to which is connected an axial drive pulley 220 (visible in FIG. 16). An axial drive tractor belt 221 is attached around axial drive pulley 220 and an axial idler pulley 222. Axial drive tractor belt 221 engages an axial drive rack 322 on visual element slide 327. Thus, when engaged, axial drive step motor 211 will urge a visual element assembly 300 from a first carriage assembly 200 axially toward an axially adjacent second carriage assembly 200. An axial drive step motor 211 will activate the axial drive tractor belt 221 on the second carriage assembly 200, which will engage the axial drive rack 322 and pull the visual element assembly 300 into place on the second carriage assembly. FIG. 10 illustrates a slide 327 being transferred between two axially adjacent carriage assemblies 200.

Axial alignment of each visual element assembly 300 on chassis 206 is maintained by axial guide shaft 223 and axial guide fin 224. Guide shaft 223 mates with linear bearings 324, which are contained by linear bearing housing 323 on visual element slide 327. Guide fin 224 mates with guide wheels 325, which are also positioned on visual element slide 327.

Visual element assembly 300 comprises visual element body 326 and visual element slide 327. Slide 327 supports visual element body 326 via extension arms 305. Slide 327 is held in place when rack 322 teeth mate with axial drive tractor belt 221. Preferably, rack 322 comprises a toothed belt fixedly attached to slide 327. As stated above, linear bearings 324 are housed in linear bearing housing 323 and serve to guide slide 327 axially along guide shaft 223. Further alignment is provided by guide wheels 325 which sandwich guide fin 224.

In order to assure timing between axial drive step motors 211 (on axially aligned carriage assemblies 200) during the transfer of a visual element assembly 300 from one carriage assembly 200 to another, and to assure axial alignment of carriage assemblies 200, optical interrupters are provided and are tied into the circuitry of the system 1. These are visible in perspective in FIGS. 8–11, and are shown in schematic form in FIG. 16. A circumferential optical interrupter 225, mounted on carriage assembly chassis 206, senses when its sight path is blocked by a circumferential optical interrupter pin 226 on the chassis 206 of an axially adjacent carriage assembly 200. An alignment signal is communicated to circuit board 210 by the interrupter 225, verifying alignment between axially adjacent carriage assemblies 200. Thus, circumferential drive optical interrupters 225 and pins 226 provide a means for verifying axial alignment of axially adjacent carriage assemblies 200. Axial drive optical interrupter 227 senses belt alignment via index holes 228 in axial drive gear 219. Timing information is communicated to circuit board 210 in order to assure timing between axial drive step motors 211 on axially adjacent carriage assemblies 200 during visual element assembly transfer to prevent excessive wear on belt and rack teeth. Slide optical interrupter 229 senses the position of axial position fin 328, communicating positioning information on slide 327, assuring that slide 327 is centered on carriage assembly 200 before the carriage assembly 200 is allowed to move circumferentially. Thus, axial drive optical interrupters 227, index holes 228, slide optical interrupters 229 and axial position fins 328 provide a means for coordinating movement of visual assemblies 300 between axially aligned carriage assemblies 200.

Figure 13:
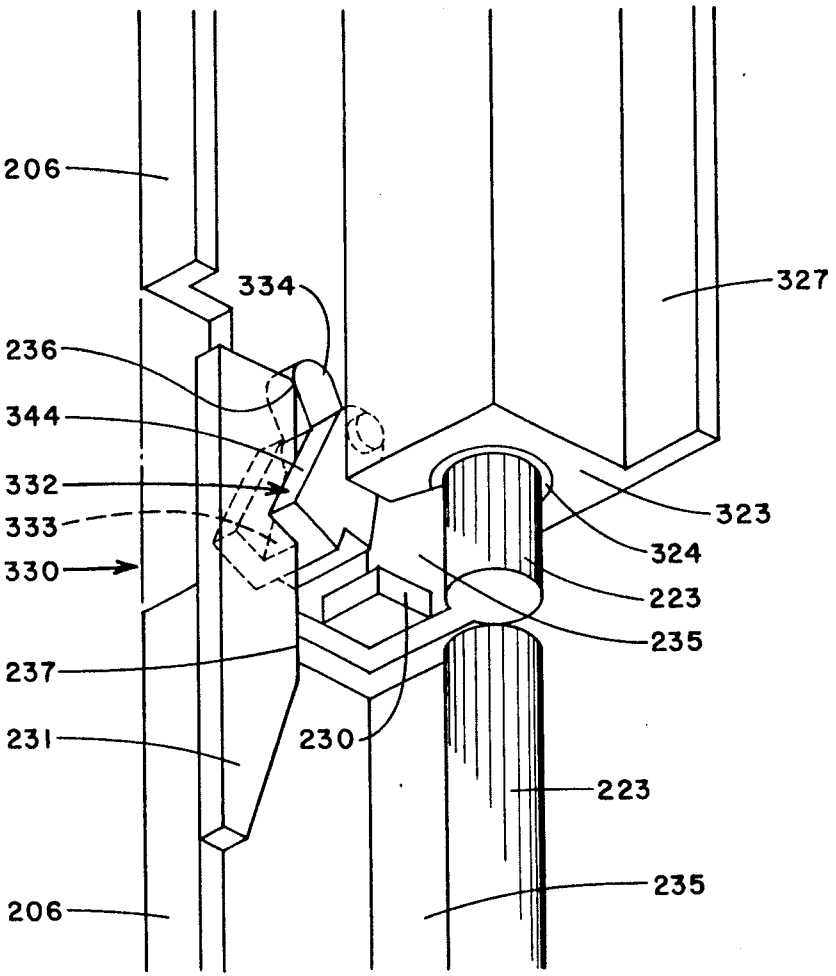
FIG. 13 is a perspective view of an embodiment of the latch axial alignment.
Figure 12:
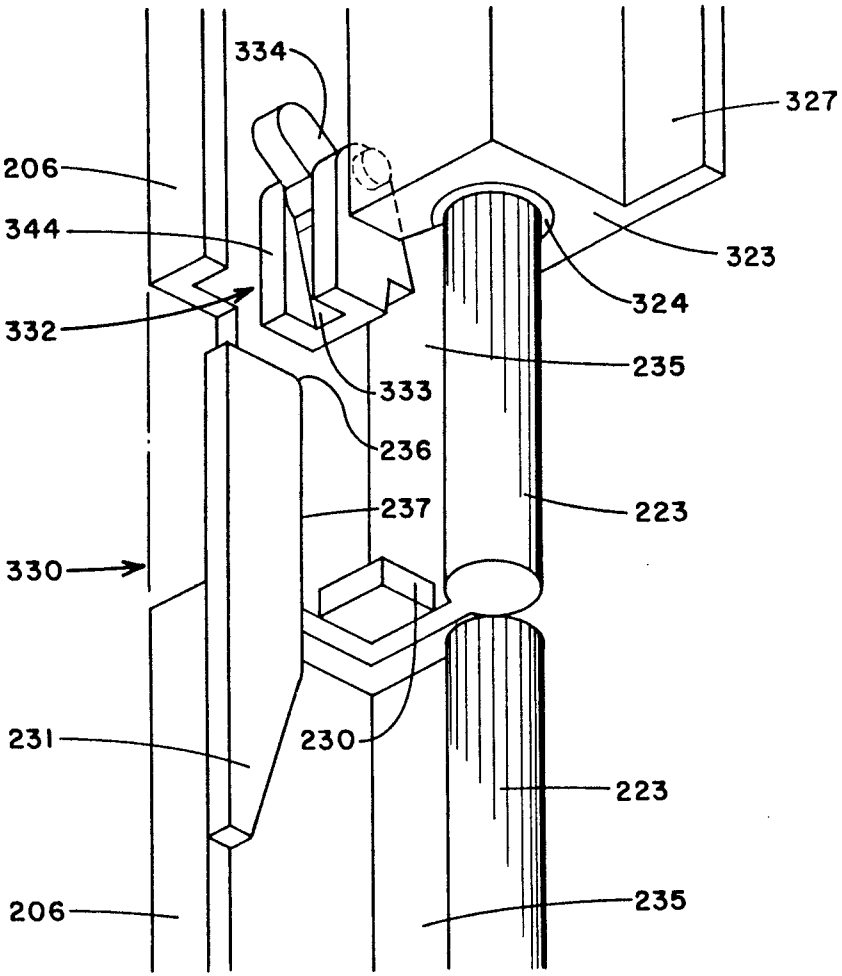
FIG. 12 is a perspective view of an embodiment of the latch means of the invention.
Figure 14:
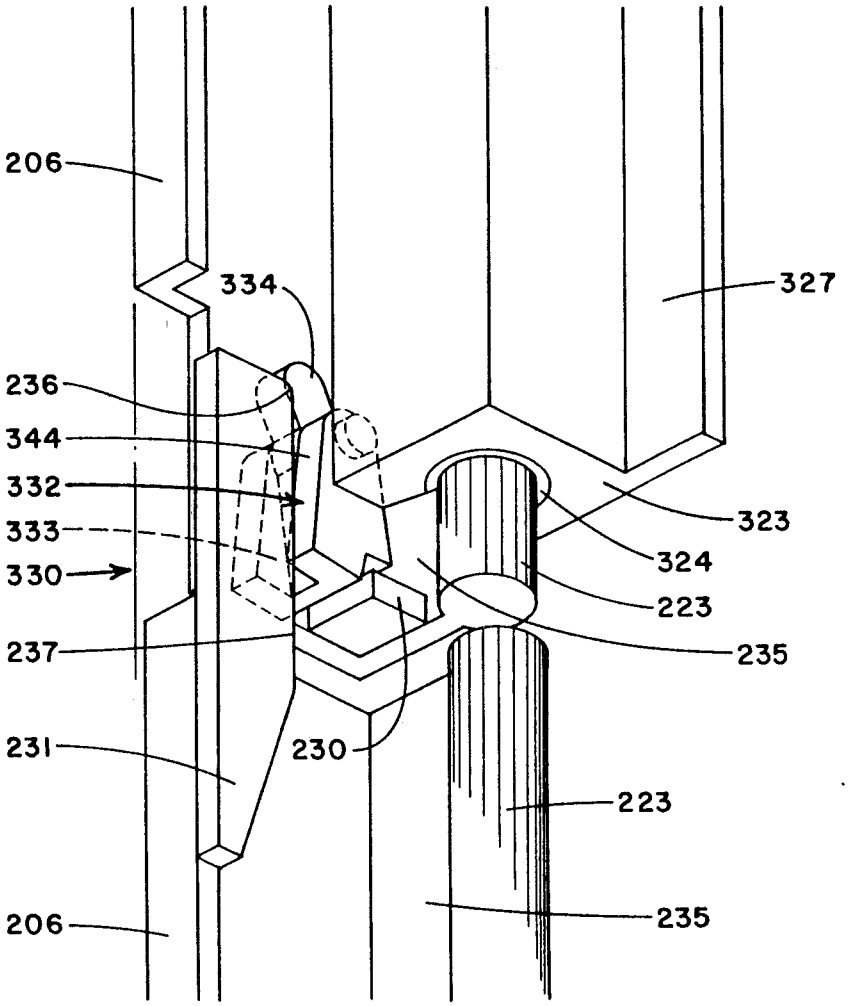
FIG. 14 is a perspective view of an embodiment of the latch means of the invention when two axially adjacent carriages are not in axial alignment.
Figure 15:
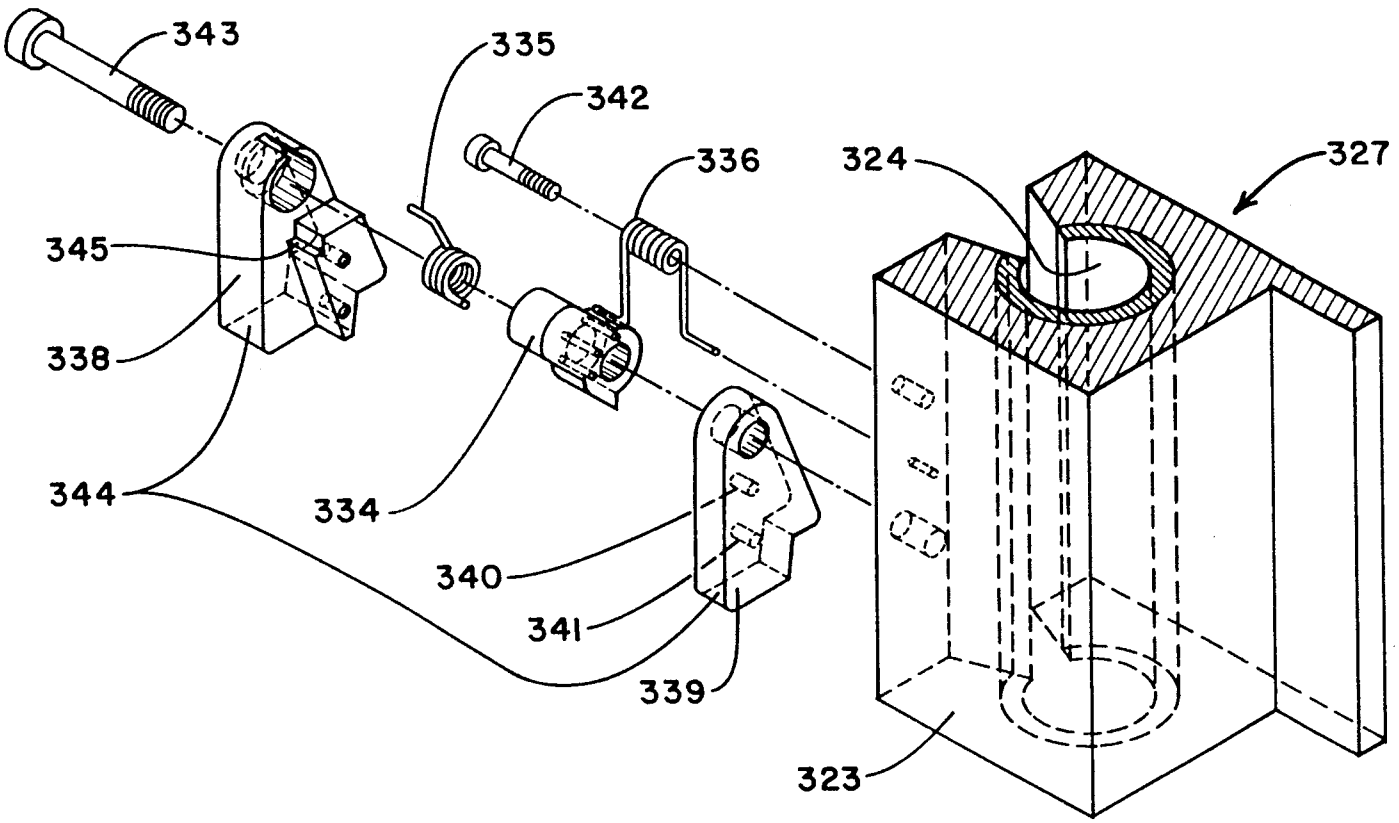
FIG. 15 is an exploded perspective view of the latch means of the invention.

Additional means for verifying axial alignment is provided by a fail-safe mechanical latch system 330, shown in FIGS. 12–15, prevents axial transfer of visual element assembly 300 from one carriage assembly 200 to another carriage assembly 200 unless the two assemblies 200 are axially aligned. Each slide 327 is provided with an upper latch system 331 and a lower latch system 332. Each latch system 330 is pivotally attached to linear bearing housing 323 of slide 327 by screw 343 and is spring biased so as to force the latch body 344 against shaft support web 235, in which position the latch body 344 would ordinarily strike latch stop 230 if an attempt were made to axially transfer slide 327 to another carriage assembly 200. This biasing occurs via external torsion spring 336, which pivots on screw 342 and which has one leg anchored in the linear bearing housing 323 and the other leg bearing against latch tongue 334. Latch tongue 334, which can pivot on screw 343 both in relation to the latch body 344 and the linear bearing housing 323, in turn bears against latch body 344 via an internal stop 345. The latch body 344 has two halves, 338, 339 aligned via pins 340, 341. As a carriage assembly 200, bearing a visual element assembly 300 begins to transfer a slide 327 to an adjacent and axially aligned carriage assembly 200, the latch tongue 334 will strike the nose 236 of cam 231 attached to chassis 206 of the adjacent carriage 200. The pressure against tongue 334, acting via internal torsion spring 335 pivoting on screw 343, in turn biases the latch body 344 against the blade 237 of cam 231. If the axial alignment between the two carriage assemblies 200 is sufficiently exact, as shown in FIG. 12 and 13, groove 333 on the latch body will mate with the blade 237 of cam 231, allowing the latch body 344 to swing clear of the latch stop 230, in turn allowing continuation of the axial transfer. If axial alignment is not sufficiently exact, as shown in FIG. 14, the groove 333 on the latch body 344 will not mate with the cam blade 237, which will cause the latch body 344 to remain in a position in which it will strike the latch stop 230, thereby stopping axial transfer of the slide 327. In this case, the internal torsion spring 335 will still allow the latch tongue 334 to swing away from cam 231 without damage. When a latch 330 is being moved past a cam 231 in a direction opposite to its active direction, the gradual slope of the cam at the end opposite nose 236 will depress latch tongue 334 thus moving the latch body 344 to an inactive position.

Visual element bodies 326 are attached to extension arms 305 via holes 337 which allow visual element bodies 326 to easily slide into place. Cowlings 103 attach to shaft 105 via tabs 111 and tab receivers 112. Similarly, carriage cowlings 201 attach to chassis 206 via tabs 232 and tab receivers 233. Any attachment means known in the art may be used for these purposes.

Figure 16:
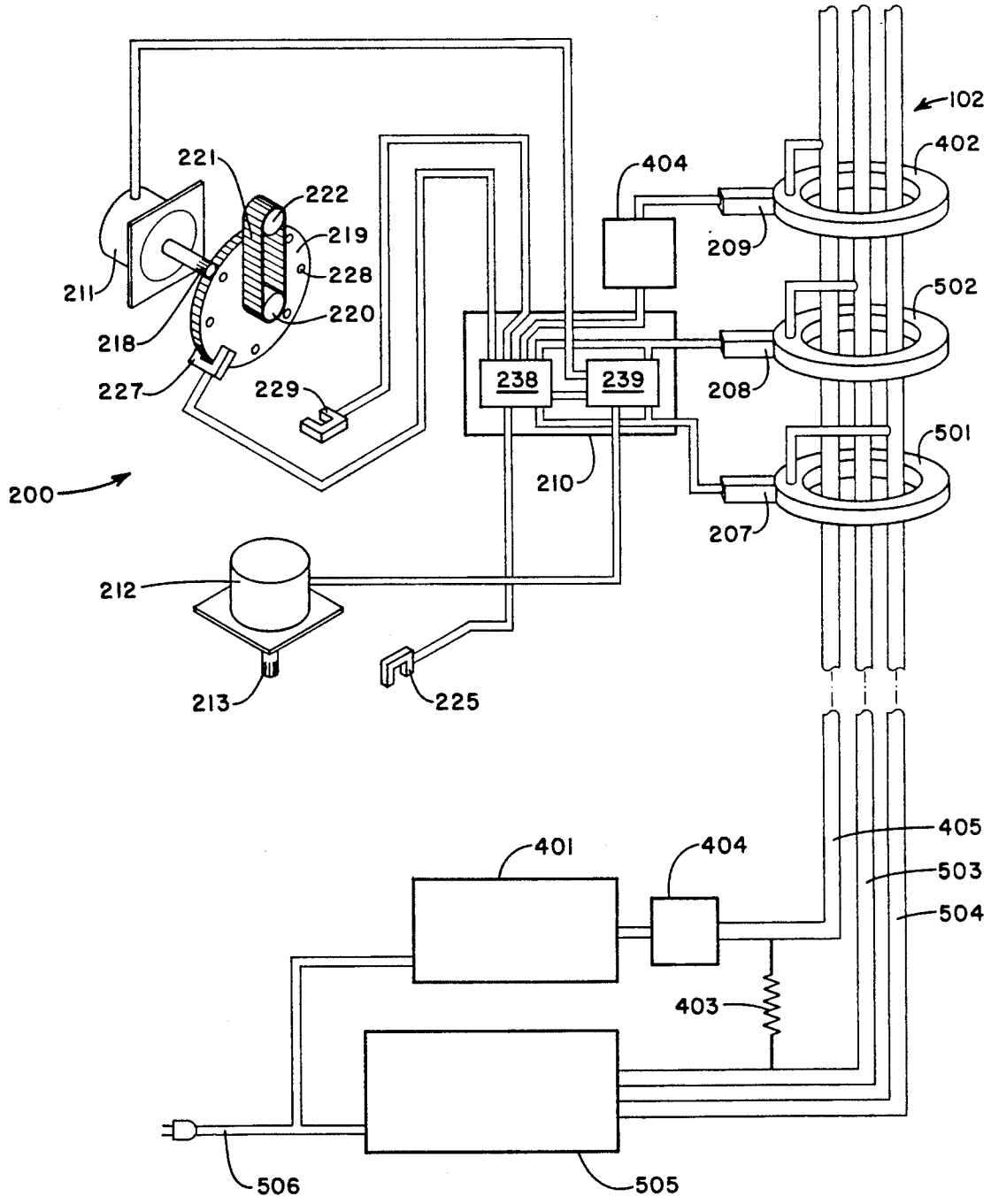
FIG. 16 is a block diagram of the power supply and control means of the invention.

FIG. 16 is a block diagram of the control means 400 and power supply means 500 of the system 1. For the sake of clarity, only a single level 102 and one carriage assembly 200 are represented along with the master control and power components normally located in base 104. In a preferred embodiment of the invention, power supply 505 receives standard 115V AC current through standard plug 506, and produces 24V DC for distribution to the carriage assemblies 200 through power line 503 and ground line 504. The master computer 401 is powered from the same 115V AC source and communicates with carriage assemblies 200 through communications line 405. At each level 102 the power, ground, and communications lines are connected to slip rings 501, 502, and 402 respectively. Each carriage assembly, in turn connects to the power, ground, and signal slip rings through contact brushes 207, 208, and 209 respectively. Each carriage assembly circuit board 210 contains a microprocessor 238 and a step motor drive circuitry 239 in a configuration well known in the art. Coordinated by the master computer 401 via a communications line 405, the circuit board 210 drives the circumferential drive step motor 212 and axial drive step motor 211 while monitoring circumferential optical interrupter 225, axial drive optical interrupter 227, and slide optical interrupter 229.

Figure 17:
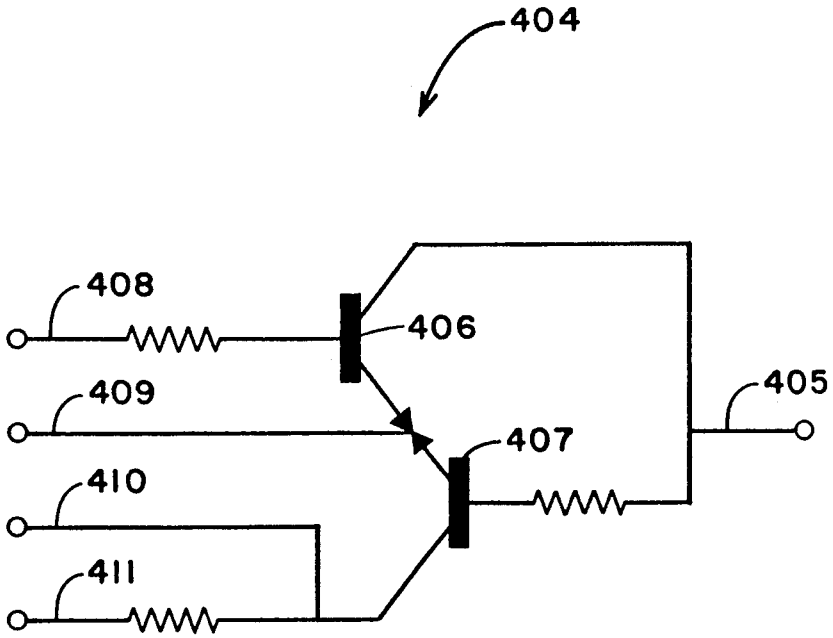
FIG. 17 is an electrical diagram illustrating an embodiment of the single conductor communications adapter circuit of the invention.

The master computer 401 and each carriage assembly circuit board 210 are equipped with a circuit 404, which allows them to transmit and receive serial data over the single conductor communications line 405 when the circuit 404, is employed with a master/slave, multidrop data communications protocol of a type well-known in the art. Thus, only one slip ring 402 need be provided at each level 102 for data communications. FIG. 17 is a diagram of circuit 404. This circuit 404 is based on two NPN transistor switches 406 and 407, which serve as logic level translators. Transistor switch 406 translates serial TTL date received from the microprocessor 238 or master computer 401 on line 408 to a high level (0 to 24 V) on the communications line 405. Transistor 407 translates serial high logic level signals from the communications line 405 to TTL levels for the microprocessor 238 or the master computer 401 on line 410. Both of these switches 406, 407 are connected to communications line 405 in a wired-0R configuration to allow alternate bidirectional communications via a single conductor. Line 409 is electrical ground from the microprocessor 238 or master computer 401, and line 411 is +5 V from the microprocessor 238 or master computer 401. Proper operation of this circuit 404 also requires a pull-up resistor 403 between communications line 405 and power line 503.

Figure 18:
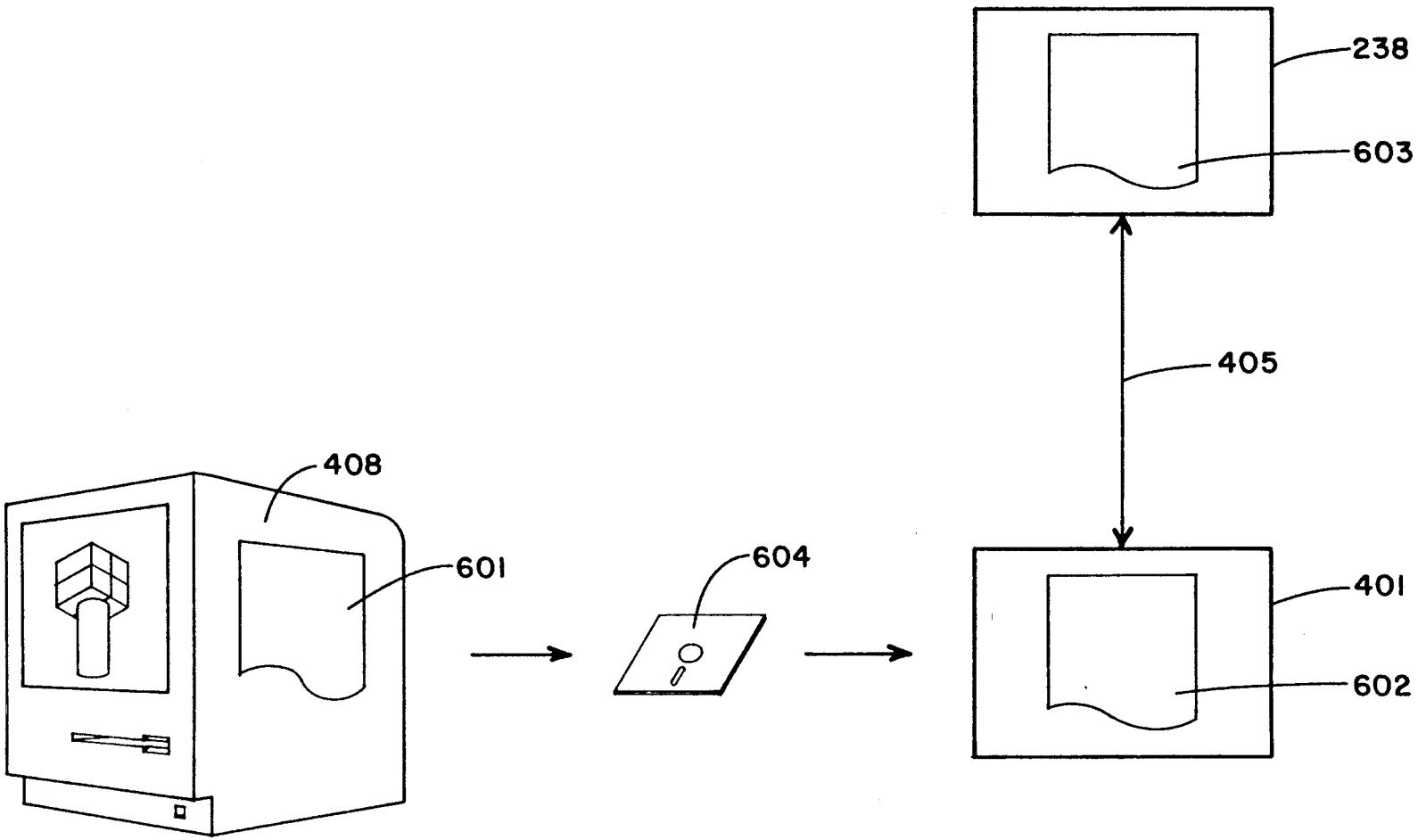
FIG. 18 a block diagram of the data flow and software components of the invention.

FIG. 18 is a block diagram of system software components and data flow. A Graphic Choreographer Program 601 running on an external computer 408 allows a visual representation of the display system to be manipulated on-screen to design a desired sequence of visual element motions. These sequences are automatically translated by the Graphic Choreographer Program 601 to set of encoded step motor commands for the various circumferential and axial drives in the system 1. These are in turn transferred to a diskette 604 for installation in the master computer 401 in the base 104 of the system 1. A System Management Program 602 in the master computer 401 distributes the sequence of step motor commands to the proper carriage assembly circuit boards 210 operating under the supervision of the Carriage Control Program 603, resident on each microprocessor 238 where the commands are interpreted and executed by the carriage assembly 200. A timing signal transmitted by the master computer 401 via communications line 405 enables the carriage assemblies 200 to remain in synchronization during execution of the movement sequences. Should the carriage assembly circuit board 210 detect failure to perform the commanded motions via its monitoring of the optical interrupters 225, 227 and 229, it can signal the master computer 401 to terminate movement on all other carriage assemblies 200. After such a malfunction, or after a power failure, the master computer 401 can interrogate the carriage assemblies 200 to obtain diagnostic information, and can then put them through a series of movements to determine their current positions as well as the positions of the visual element assemblies 300 borne by them; the master computer 401 can then direct the carriage assemblies 200 to return themselves and the visual element assemblies 300 to a home position in preparation for subsequent movement sequences.

A review of FIGS. 8–11 will reveal how various components of the system 1 work together to create visual element movement. Some of the components have obviously been removed for clarity. For example, the entire visual element assemblies 300 are not shown, but the positioning of the visual element slides 327 illustrate the positioning of the corresponding visual element bodies 326. In FIG. 8, two slides 327 are held in place on lower level 113 by corresponding carriage assemblies 200. Two other carriage assemblies 200 are located on upper level 114. As shown, each carriage assembly 200 travels around shaft 105, guided by top carriage wheels 208, which are in turn guided by bottom "V" bosses 108, and bottom carriage wheels 204, which are in turn guided by top "V" bosses 107 (hidden from view). Circumferential drive step motors 212 cause circumferential tractor drive belts 216 to engage fixed belts 110 on flanges 106 to move carriage assemblies 200 around shaft 105.

FIG. 9 shows the positioning of the assemblies shown in FIG. 8 after the carriage assemblies 200 on lower level 113 have moved circumferentially into axial alignment with carriage assemblies 200 on upper level 114. When axial movement of a visual element assembly 300 is desired, at least two carriage assemblies 200, one of which is carrying a visual element assembly 300, are aligned axially. As stated previously, positioning of a carriage assembly 200 is sensed and verified by the positioning of circumferential optical interrupter 225 and circumferential optical interrupter pin 226, shown in aligned position in FIG. 9.

As shown in FIGS. 9 and 10, once two carriage assemblies 200 are axially aligned, slide 327 on lower level 113 may be transferred to the empty carriage assembly 200 on upper level 114. It should again be understood that the movement patterns shown are illustrative only. For example, as long as multiple carriage assemblies 200 are axially aligned, visual element assemblies 300 may be transferred over multiple levels 102. Also, since each carriage assembly 200 is independently powered, multiple simultaneous axial alignments and axial transfers of visual element assemblies 300 are possible. However, axial alignment does not necessarily require that an axial transfer take place. As shown in FIG. 10, one axially aligned slide 327 is moving upward to upper level 114 while another is remaining on lower level 113.

Movement from lower level 113 to upper level 114 takes place when axial drive step motor 211 urges axial drive tractor belt 221 into contact with rack 322 (see FIGS. 10 and 11), moving slide 327 upward. Slide optical interrupter 229 verifies the axial position of slide 327 and axial drive optical interrupters 227 on the axially adjacent carriage assemblies 200 coordinate axial drive step motors 211 on the axially adjacent carriage assemblies 200. Thus, as slide 327 moves upward toward the carriage assembly 200 on upper level 114, rack 322 engages the axial drive tractor belt 221 on the carriage assembly 200 and slide 327 is pulled into place on upper level 114.

As can be seen, a display system is provided which enables the user to move visual elements in a virtually limitless combination of ways. The system can be oriented vertically or otherwise. Carriage assemblies 200 carry visual elements 300 circumferentially around shaft 105 as well as transfer visual elements 300 axially along shaft 105. Entire visual faces oriented in one direction may be disassembled and reassembled oriented in another direction in an eye-catching fashion. Moving sculptures and other art objects are capable of being formed utilizing the system and method of this invention. Many varying embodiments of the invention will occur to those skilled in the art, and are intended to be included within the scope and spirit of the following claims.

I claim:

1. A display system comprising:

a. a shaft means, for supporting said display system:

b. a plurality of carriage means, positioned on said shaft means such that carriage means are each independently movable circumferentially around said shaft means to independent positions;

c. a plurality of motorized circumferential motive means, each said circumferential motive means connected to one said carriage means, for independently moving said carriage means circumferentially about said shaft means, each said circumferential motive means and connected said carriage means forming an independently movable unit; and d. a plurality of visual elements, each said visual element connectable to one said carriage means.

2. A display system according to claim 1, e. a plurality of motorized axial motive means, each mounted on one said carriage means and engageable with at least one said visual element, for transferring said visual element axially from one said carriage means to an axially adjacent said carriage means.

3. A display system according to claim 2, further comprising:

e. a control means for controlling independent activation and deactivation of each said circumferential motive means and each said axial motive means, operatively connected to said circumferential motive means and said axial motive means.

4. A display system according to claim 3, wherein said control means comprises a computer system programmed to control movement of said carriage means in a desired manner.

5. A display system according to claim 1, further comprising:

e. a control means for controlling independent activation and deactivation of each said circumferential motive means, operatively connected to said circumferential motive means.

6. A display system according to claim 5, wherein said control means comprises a computer system programmed to control movement of said carriage means in a desired manner.

7. A display system according to claim 1, wherein said shaft means is vertically oriented.

8. A display system according to claim 1, wherein said shaft means is horizontally oriented.

9. A display system according to claim 1, wherein said shaft means is diagonally oriented.

10. A display system according to claim 1, wherein said shaft means includes at least one track means, disposed circumferentially around said shaft means, for supporting and guiding movement of said carriage means.

11. A display system according to claim 1, further comprising:

e. a means, for verifying axial alignment of axially adjacent said carriage means, operatively connected to said control means.

12. A display system according to claim 11, further comprising:

a means, for coordinating movement of said visual element between axially aligned said carriage means, operatively connected to said control means.

13. A display system according to claim 6, wherein said computer system includes:

i. a plurality of microprocessors, each said microprocessor operatively connected via electronic circuitry to at least one said motorized circumferential motive means; and ii. a master computer, operatively connected via electronic circuitry to said microprocessors.

14. A display system according to claim 4, wherein said computer system includes:

i. a plurality of microprocessors, each said microprocessor operatively connected via electronic circuitry to at least one said motorized circumferential motive means and to at least one said motorized axial motive means;

ii. a master computer, operatively connected via electronic circuitry to said microprocessors.

15. In a display system comprising a shaft means, for supporting said display system; a plurality of carriage means, positioned on said shaft means such that said carriage means are each independently movable circumferentially around said shaft means to independent positions; a plurality of motorized circumferential motive means, each said circumferential motive means connected to one said carriage means, for moving said carriage means circumferentially about said shaft means, each said circumferential motive means and connected said carriage means forming an independently movable unit; and a plurality of visual elements, each said visual element connectable to one said carriage means, a process for displaying said visual elements, comprising the steps of:

a moving at leas tone said visual element mounted on one said carriage means around said shaft means to establish a first desired configuration; and b. moving at least one said visual element mounted on said carriage means around said shaft means to establish a second desired position.

16. In a display system comprising a shaft means, for supporting said display system; a plurality of carriage means, positioned on said shaft means such that a plurality of said carriage means may be circumferentially moved to axially adjacent positions; at least one visual element, connectable to said carriage means; and a plurality of motorized axial motive means, each mounted on one said carriage means and engageable with said visual element, for transferring said visual element axially from one said carriage means to an axially adjacent said carriage means, a process for displaying said visual elements, comprising the steps of:

a. moving at least one selected visual element mounted on a first said carriage means circumferentially around said shaft means to a desired position;

b. aligning said first carriage means with a second said carriage means axially adjacent thereto; and c. axially transferring said visual element to said second carriage means.

17. A process for displaying visual elements according to claim 16, comprising the additional step of:

d. repeating said steps of moving, aligning and transferring visual elements in said display system in a desired order.

18. A display system comprising:

a. a shaft means, for supporting said display system;

b. at least one carriage means, positioned on said shaft means such that carriage means is independently movable circumferentially around said shaft means to independent positions;

c. at least one motorized circumferential motive means, connected to said carriage means, for independently moving said carriage means circumferentially about said shaft means;

at least one visual element, connectable to said carriage means; and e. at least one motorized axial motive means, mounted on one said carriage means and engageable with at least one said visual element, for moving said visual element axially of said shaft means.

19. A display system according to claim 18, further comprising a plurality of said circumferential motive means, each said circumferential motive means being connected to at least one said carriage means, and a plurality of said carriage means, positioned on said shaft means such that a plurality of said carriage means may be circumferentially moved to axially adjacent positions, said display system further comprising a plurality of motorized axial motive means, each mounted on one said carriage means and engageable with at least one said visual element, for transferring said visual element axially from one said carriage means to an axially adjacent said carriage means.

20. A display system according to claim 19, further comprising a control means for controlling independent activation and deactivation of each said circumferential motive means and each said and each said axial motive means, operatively connected to said circumferential motive means and said axial motive means.

* * * * *